US010234810B2

(12) United States Patent
Ohmura et al.

(10) Patent No.: US 10,234,810 B2
(45) Date of Patent: Mar. 19, 2019

(54) CONVEYANCE DEVICE AND IMAGE FORMING APPARATUS INCORPORATING SAME

(71) Applicants: Tomoya Ohmura, Kanagawa (JP); Yuuki Nobuoka, Kanagawa (JP)

(72) Inventors: Tomoya Ohmura, Kanagawa (JP); Yuuki Nobuoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 15/227,545

(22) Filed: Aug. 3, 2016

(65) Prior Publication Data

US 2017/0057774 A1 Mar. 2, 2017

(30) Foreign Application Priority Data

Aug. 28, 2015 (JP) ..... 2015-169376

(51) Int. Cl.
*G03G 15/00* (2006.01)
*G03G 15/16* (2006.01)

(52) U.S. Cl.
CPC ..... *G03G 15/657* (2013.01); *G03G 15/167* (2013.01); *G03G 15/1675* (2013.01); *G03G 15/6558* (2013.01); *G03G 15/6529* (2013.01); *G03G 15/6567* (2013.01); *G03G 2215/00409* (2013.01); *G03G 2215/00654* (2013.01); *G03G 2215/00658* (2013.01)

(58) Field of Classification Search
CPC ..... G03G 15/6529; G03G 15/6558; G03G 15/6567; G03G 15/167; G03G 15/1675; G03G 15/657; G03G 2215/00409; G03G 2215/00649; G03G 2215/00654; G03G 2215/00658
See application file for complete search history.

(56) References Cited

U.S. PATENT DOCUMENTS 5,276,489 A * 1/1994 Kikuchi ..... G03G 15/167 399/313
5,552,873 A * 9/1996 Hirao ..... G03G 15/165 399/312
5,614,997 A * 3/1997 Marumoto ..... G03G 15/1635 399/121
6,055,395 A * 4/2000 Hiramoto ..... G03G 15/1635 399/121

(Continued)

FOREIGN PATENT DOCUMENTS

JP 2010-072243 4/2010

OTHER PUBLICATIONS

U.S. Appl. No. 15/140,923, filed Apr. 28, 2016.

*Primary Examiner* — Ernesto A Suarez

(74) *Attorney, Agent, or Firm* — Oblon, McClelland, Maier & Neustadt, L.L.P.

(57) ABSTRACT

A conveyance device includes a guide, a positioner, and a pusher. The guide extends in a longitudinal direction of an image bearer and is disposed upstream from a transfer position, at which an image is transferred from the image bearer to the recording medium, in a direction of conveyance of a recording medium to guide the recording medium. The positioner positions an end of the guide relative to the image bearer. The pusher contacts the guide at a position closer to a center of the guide than the end of the guide in the longitudinal direction, to push the guide toward the image bearer.

17 Claims, 14 Drawing Sheets

(56) References Cited

U.S. PATENT DOCUMENTS

| | | | | |
|---|---|---|---|---|
| 6,256,472 | B1 * | 7/2001 | Miyake | G03G 15/167 399/313 |
| 6,493,534 | B2 * | 12/2002 | Sawanaka | G03G 15/6558 399/316 |
| 8,055,170 | B2 * | 11/2011 | Taniguchi | G03G 15/6558 399/316 |
| 8,855,543 | B2 * | 10/2014 | Deguchi | G03G 15/6558 399/316 |
| 8,953,983 | B2 * | 2/2015 | Iikura | G03G 15/6558 399/124 |
| 2010/0067952 | A1 | 3/2010 | Fujita et al. | |
| 2015/0268626 | A1 | 9/2015 | Saito et al. | |
| 2015/0346652 | A1 | 12/2015 | Ohmura | |
| 2016/0033919 | A1 * | 2/2016 | Egi | G03G 15/6529 399/397 |
| 2016/0041509 | A1 | 2/2016 | Sekiguchi et al. | |
| 2016/0131999 | A1 | 5/2016 | Kojima et al. | |

* cited by examiner

CONVEYANCE DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2015-169376 filed on Aug. 28, 2015 in the Japan Patent Office, the entire disclosure of which is hereby incorporated by reference herein.

BACKGROUND

Technical Field

Aspects of the present disclosure generally relate to a conveyance device and an image forming apparatus incorporating the conveyance device.

Related Art

An electrophotographic image forming apparatus forms an electrostatic latent image on a surface of an image bearer, develops the electrostatic latent image with electrically-charged developer, and transfers the image on a recording medium at a transfer position. In such a configuration, if the conveyance behavior of the recording medium is disturbed at an upstream side from the transfer position in a direction of conveyance of the recording medium, an abnormal image might be formed. Hence, such an image forming apparatus may include a guide to guide the recording medium to a target position.

SUMMARY

In an aspect of the present disclosure, there is provided a conveyance device that includes a guide, a positioner, and a pusher. The guide extends in a longitudinal direction of an image bearer and is disposed upstream from a transfer position, at which an image is transferred from the image bearer to the recording medium, in a direction of conveyance of a recording medium to guide the recording medium. The positioner positions an end of the guide relative to the image bearer. The pusher contacts the guide at a position closer to a center of the guide than the end of the guide in the longitudinal direction, to push the guide toward the image bearer.

In an aspect of the present disclosure, there is provided an image forming apparatus that includes the image bearer, a transferor, and the conveyance device. The transferor is disposed opposite the image bearer to form the transfer position between the transferor and the image bearer. The conveyance device extends in the longitudinal direction of the image bearer and is disposed upstream from the transfer position in the direction of conveyance of a recording medium, to guide the recording medium.

In an aspect of the present disclosure, there is provided an image forming apparatus that includes a housing, an image bearer, a guide, and a corrector. The image bearer is supported by the housing. The guide is disposed upstream from a transfer position, at which an image is transferred from the image bearer to a recording medium, in a direction of conveyance of the recording medium to guide the recording medium. The guide has an end in a longitudinal direction of the guide. The end is supported by the housing. The corrector contacts the guide at a position closer to a center of the guide than the end of the guide in the longitudinal direction, to correct warpage of the guide.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
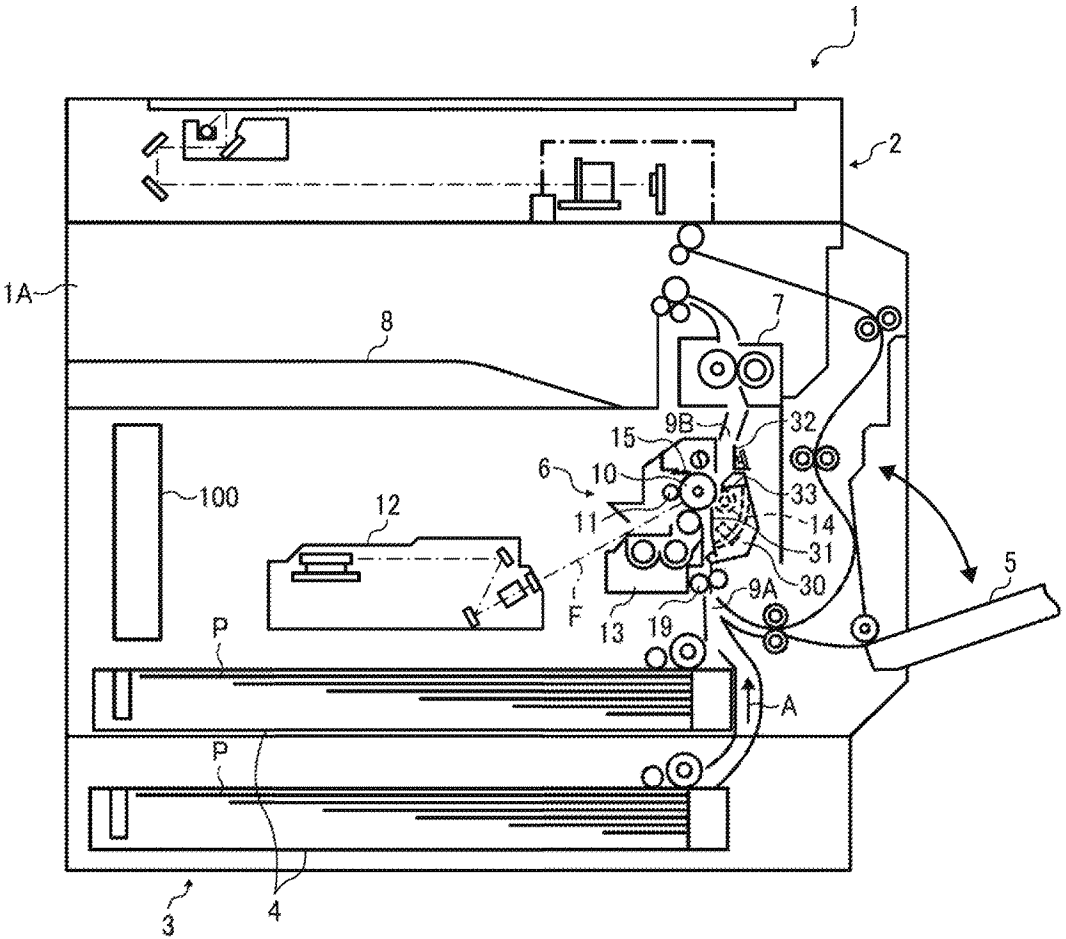
FIG. 1 is an illustration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, an image forming apparatus according to some embodiments of the present disclosure is described below. A conveyance device according to some embodiments of the present disclosure extends in a longitudinal direction (also referred to as width direction) of an image bearer. At an upstream side from a transfer position, at which an image is transferred from the image bearer to the recording medium, the conveyance device presses a pusher against a guide, which guides the recording medium conveyed, at a position closer to a center than an end of the guide so as to push the guide toward the image bearer, thus reducing the bending of the guide. For the following embodiments, components having the same function and configuration are appended with the same reference codes and redundant description thereof may be omitted. Components in the drawings may be partially omitted to facilitate understanding of the configurations.

FIG. 1 is an illustration of an image forming apparatus according to an embodiment of the present disclosure. In FIG. 1, the image forming apparatus is illustrated as a copier. However, the image forming apparatus according to embodiments are not limited to a copier and may be, for example, a printer, a stand-alone fax machine, or a multi-function peripheral including at least two functions of a copier, a printer, a fax machine, and a scanner. An image forming apparatus 1 illustrated in FIG. 1 includes a scanner device 2 as an image reading device and a printer device 3 that forms an image on a sheet-shaped recording medium P from a scanned image read from an original copy by the scanner device 2. The printer device 3 is disposed in an apparatus body (housing) 1A. The printer device 3A includes a tray 4 as a sheet feeder to contain stacked recording media P, a bypass feeder 5 to receive a manually fed recording medium P, an image forming unit 6 as a printer engine, a fixing device 7, and an optical writing device 12. A space is disposed between the scanner device 2 and the printer device 3. In an upper part of the space above the printer device 3 is provided a stacker 8 on which ejected recording media P are stacked. An upstream conveyance path 9A runs from the tray 4 or the bypass feeder 5 to the image forming unit 6, and a downstream conveyance path 9B runs from the image forming unit 6 to the fixing device 7. The recording medium P is conveyed through the upstream conveyance path 9A and the downstream conveyance path 9B. In FIG. 1, a direction of conveyance of the recording medium P is indicated by arrow A (hereinafter referred to as recording-medium conveyance direction A).

Figure 2:
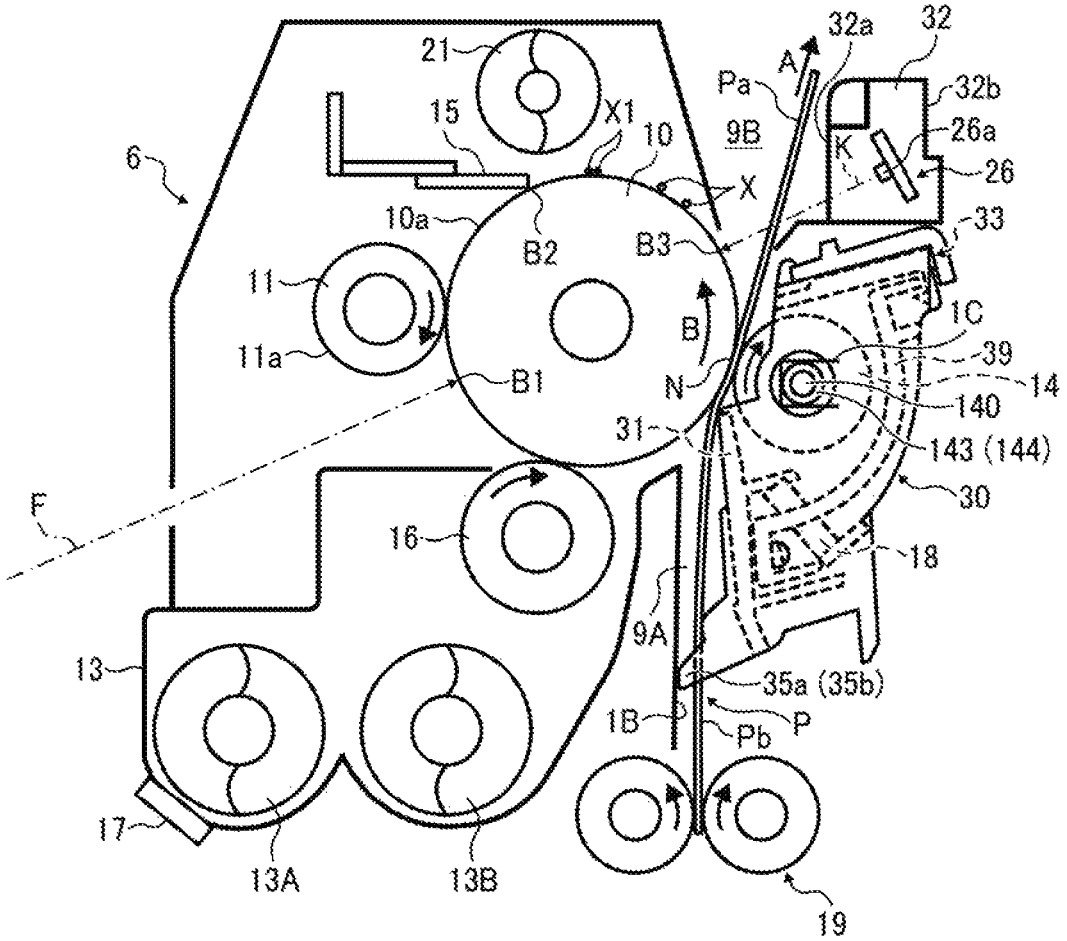
FIG. 2 is an enlarged view of a configuration of the outer appearance of a conveyance device according to an embodiment of the present disclosure.
Figure 3:
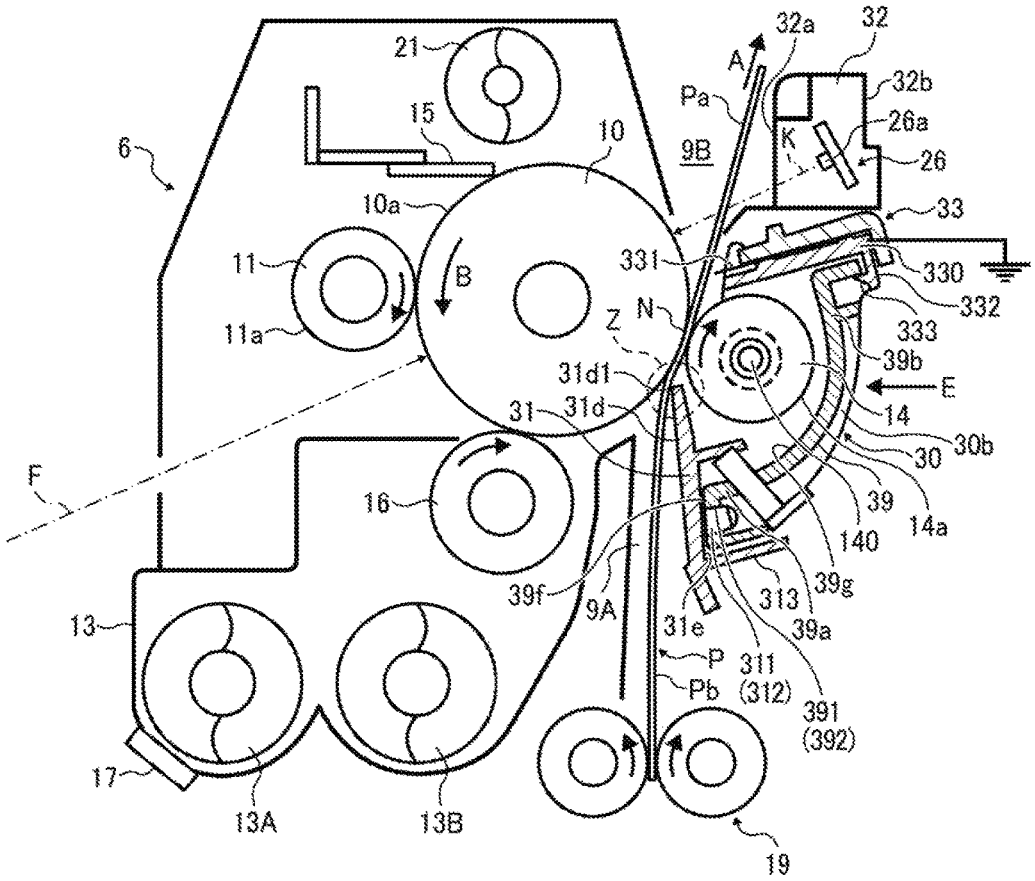
FIG. 3 is an enlarged view of the configuration of the conveyance device of FIG. 2.

As illustrated in FIGS. 2 and 3, the image forming unit 6 includes a drum-shaped photoconductor 10 as an image bearer having a photoconductive layer on a surface (referred to as a photoconductor surface 10*a*) of the photoconductor. The photoconductor 10 is supported by, for example, side plates of the printer device 3 to be rotatable in a counter-clockwise direction indicated by arrow B in FIG. 2 (hereinafter referred to as photoconductor rotating direction B). A drive motor 40 as a drive source illustrated in FIG. 9 rotates the photoconductor 10 in the photoconductor rotating direction B. A charging roller 11, a light-emission and exposure target position B1 for a writing light F from the optical writing device 12 (see FIG. 1), a developing device 13, a transfer roller 14, and a cleaning blade 15 are arranged in series around the photoconductor 10 according to the electrophotographic process. The charging roller 11 is a charger, the transfer roller 14 is a transferor, and the cleaning blade 15 is a cleaner. The photoconductor 10 is supported by the apparatus body (housing) 1A directly or indirectly via a frame or a unit. The optical writing device 12 illustrated in FIG. 1 emits the writing light F, which is a laser light generated by a laser diode based on image date read from an original copy by the scanner device 2, onto the photoconductor surface 10*a* on the photoconductor 10 as the image bearer to perform optical scanning. An electrostatic latent image is formed on the photoconductor surface 10*a* by the optical scanning.

As illustrated in FIGS. 2 and 3, the present embodiment employs a contact-transfer system in which a surface 14*a* of the rotatable transfer roller 14 contacts the photoconductor surface 10*a* to form a transfer nip N as the transfer position. A transfer bias is applied from a transfer-bias power source to the transfer roller 14. The transfer roller 14 forms the transfer nip N as the transfer position at which a visible toner image formed on the photoconductor surface 10*a* is transferred, by application of a transfer bias, onto the recording medium P conveyed through the upstream conveyance path 9A. In some embodiments, the transferor may be a rotatable transfer brush instead of the transfer roller 14.

The developing device 13 includes a developing sleeve 16 as a developer bearer that opposes the photoconductor surface 10*a* to supply toner, which is also a developer, to the electrostatic latent image, a toner sensor 17 as a developer density detector, and a pair of conveyance screws 13A and 13B as developer conveyors. In the developing device 13 thus configured, the electrostatic latent image on the photoconductor surface 10*a* is developed with the developer to form a toner image. A P-sensor 18 as the image density detector detects toner density of the toner image formed on the photoconductor surface 10*a*.

Paired registration rollers 19 that control the timing at which the recording medium P is conveyed to the transfer nip N are disposed on the upstream conveyance path 9A upstream of the transfer nip N in the recording-medium conveyance direction A. A conveyance device 30 is disposed between the paired registration rollers 19 and the fixing device 7, to rotatably support the transfer roller 14. When the photoconductor 10 rotates with an edge of the cleaning blade 15 being in contact with the photoconductor surface 10*a*, the cleaning blade 15 wipes off an adhering substance X, which is residual toner or aggregated toner adhering to the photoconductor surface 10*a*, and an adhering substance X1, which is paper dust, to clean the photoconductor surface 10*a*. In the embodiment, as illustrated in FIG. 2, the position at which the cleaning blade 15 contacts the photoconductor surface

10*a* is referred to as cleaning position B2. That is, the cleaning blade 15 forms the cleaning position B2 at which the adhering substance X and the adhering substance X1 adhering to the photoconductor surface 10*a* after transferring of the image at the transfer nip N are cleaned off.

In such a configuration, a surface 11*a* of the charging roller 11 is in contact with the photoconductor surface 10*a*. When the photoconductor 10 rotates, a charging bias is applied to the charging roller 11 to uniformly supply charges to the photoconductor surface 10*a*. Thus, the photoconductor surface 10*a* is uniformly charged at a constant potential. The charged photoconductor surface 10*a* is irradiated with the writing light F from the optical writing device 12 to be optically scanned and thereby an electrostatic latent image is formed. As the photoconductor 10 rotates, the electrostatic latent image is developed with toner supplied from the developing sleeve 16 to turn into a toner image while passing the front of the developing sleeve 16 of the developing device 13. The recording medium P is fed from, e.g., the tray 4 and sent to the transfer nip N by the paired registration rollers 19. When the recording medium P passes the transfer nip N, the transfer action (transfer electric field) of the transfer roller 14 transfers the toner image formed on the photoconductor surface 10*a* onto the recording medium P. The recording medium P with the toner image transferred thereon is conveyed to the fixing device 7 illustrated in FIG. 1, and the toner image is melted under heat and pressure to be fixed onto the recording medium P. After the fixing of the toner image, the recording medium P is sequentially ejected as an output image (duplication) and stacked on the stacker 8.

The contact-transfer system employed in the embodiment is described below. The transfer roller 14 is a transferor of the contact-transfer system. When applied DC 1000 V under a moderate-temperature of 23° C. and a moderate humidity of 50% Rh, the resistance value of the transfer roller 14 is $10^6\Omega$ to $10^9\Omega$. The transfer bias supplied from the transfer-bias power source to the transfer roller 14 is controlled by a constant current control. That is, in the embodiment, the transfer bias applied to the transfer roller 14 is adjusted so that the value of a current flowing during the passage (printing) of a paper be constant. Basically, to transfer an image, a charge having an opposite polarity to a polarity of the toner is applied to a back face Pb of the recording medium P to electrically attract the toner image on the photoconductor surface 10*a* to a front face Pa of the recording medium P. The front face Pa of the recording medium P is a surface onto which the toner image is transferred and that faces the photoconductor surface 10*a*. The back face Pb of the recording medium P is the opposite side of the front face Pa and does not face the photoconductor surface 10*a*. The adhering substance X and the adhering substance X1 remain on the photoconductor surface 10*a* after transfer. As the adhering substances X and the adhering substance X1 are sent by rotation of the photoconductor 10 to the cleaning position B2 at which the cleaning blade 15 is in contact with the photoconductor 10, and the adhering substances X and the adhering substance X1 are wiped off and cleaned from the photoconductor surface 10*a* by the cleaning blade 15. The wiped-off adhering substances X and X1 are conveyed toward the developing device 13 by a collection conveyance screw 21 disposed near the cleaning blade 15. The conveyed substances are supplied again to the developing device 13 together with the fresh toner, namely, recycled.

As illustrated in FIGS. 2 and 3, a charge-removing light source 26 serving as a light irradiator and a charge-removing device is disposed on the downstream conveyance path 9B at a downstream side from a transfer nip N in the recording-medium conveyance direction A. The charge-removing light source 26 emits a charge-removing light K to a target position of the photoconductor surface 10*a* downstream from the transfer nip N and upstream from the cleaning blade 15 in the photoconductor rotating direction B, to reduce the surface potential of the photoconductor 10 before cleaning. The emitted light amount of a light source portion 26*a* of the charge-removing light source 26 is adjustable. In the present embodiment, a light-emitting diode (LED) is used for the light source portion 26*a* of the charge-removing light source 26. Instead of such an LED, the light source portion 26*a* may be of any light source portion, such as an electro luminescence (EL), which can emit a sufficient light amount to remove a charge from the photoconductor surface 10*a*. The charge-removing light source 26 is disposed at a side facing the back face Pb of the recording medium P conveyed through the downstream conveyance path 9B, to irradiate the photoconductor surface 10*a* with the charge-removing light K passing through the recording medium P. The charge-removing light source 26 is disposed such that the optical axis passes the rotational center of the photoconductor 10 so that the charge-removing light K is emitted to the rotational center of the photoconductor 10. The photoconductor surface 10*a* is irradiated with the charge-removing light K at the emission target position B3.

Figure 4:
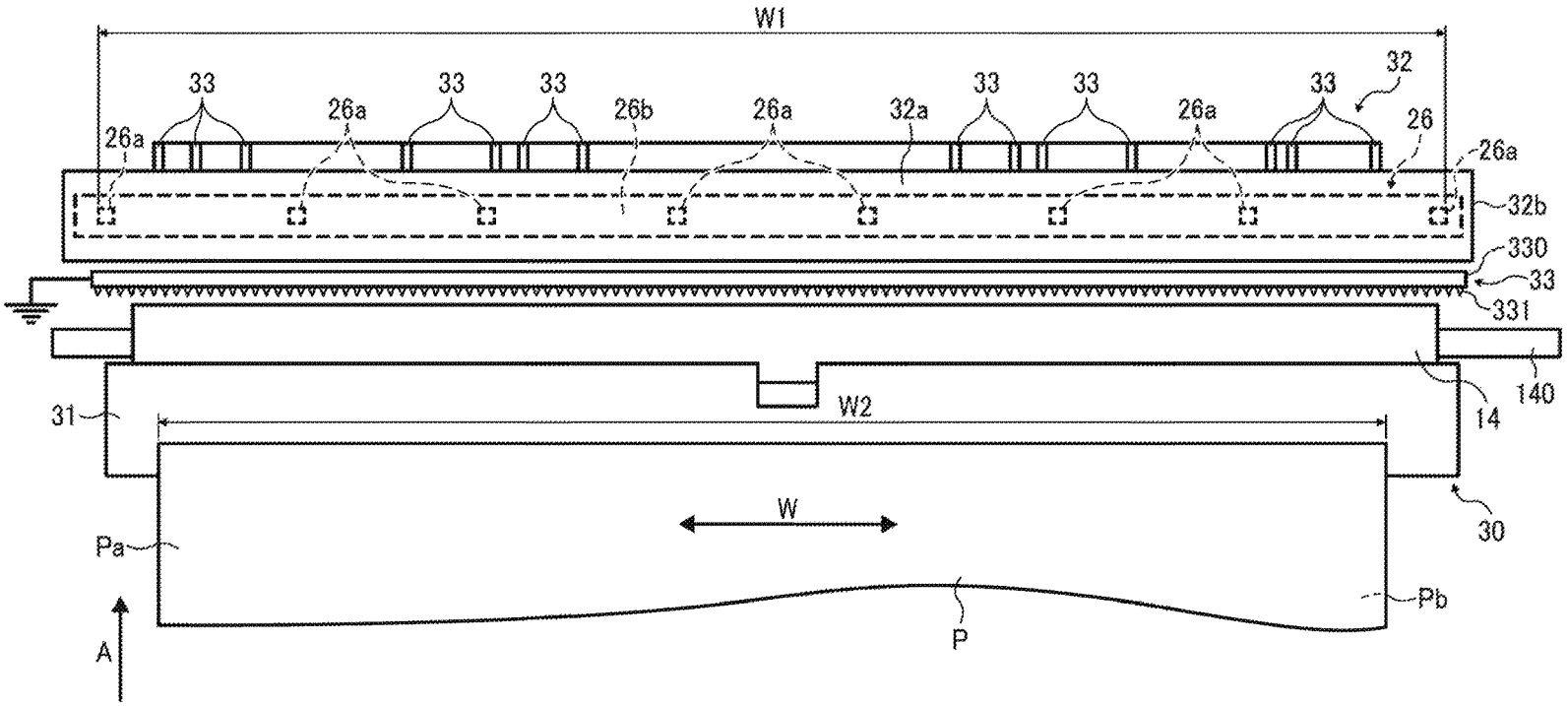
FIG. 4 is an enlarged view of a charge remover and a downstream guide.

An exit guide 32 having a light permeability is disposed between the transfer roller 14 and the fixing device 7. The exit guide 32 acts as a conveyance guide to convey and guide the recording medium P passing through the downstream conveyance path 9B toward the fixing device 7 (see FIG. 1) and a cover to cover the charge-removing light source 26. The exit guide 32 is made of transparent resin and is disposed between the light source portion 26*a* of the charge-removing light source 26 and the photoconductor 10 to cover at least the light source portion 26*a* and to guide the conveyed recording medium P. In the present embodiment, the exit guide 32 and the charge-removing light source 26 are disposed separately from the conveyance device 30. However, in some embodiments, the exit guide 32 and the charge-removing light source 26 may be integrally molded with the conveyance device 30. As illustrated in FIG. 4, the charge-removing light source 26 includes a plurality of light source portions 26*a* linearly arranged and spaced away from each other in a width direction of the recording medium P indicated by arrow W. The width direction W is a direction perpendicular to the recording-medium conveyance direction A on the same plane, and is also a longitudinal direction of each of the photoconductor 10 and an entry guide 31. Therefore, the width direction W may also referred to as the longitudinal direction W. In the present embodiment, the charge-removing light source 26 includes the plurality of light source portions 26*a* disposed on a single base plate. However, in some embodiments, a plurality of charge-removing light sources 26, each including a single light source portion 26*a* disposed on a single base plate, may be arranged along the width direction W.

The light source portions 26*a* of the charge-removing light source 26 are arranged such that end portions of irradiation areas of charge-removing light K emitted from adjacent ones of the light source portions 26*a* overlap each other to give approximately uniform light intensity in an irradiation range indicated by W1 in FIG. 4. The irradiation range W1 on the photoconductor 10 irradiated with the charge-removing light K is wider than at least a lateral width W2 of the recording medium P. In the present embodiment, an area (effective image area) of the photoconductor surface

10*a* on which an image may be formed is irradiated with the charge-removing light K emitted from the charge-removing light source 26 before cleaning, thus reducing the residual potential of the photoconductor surface 10*a* after the transfer.

As illustrated in FIGS. 2 and 3, the charge-removing light source 26 is disposed between a conveyance guide face 32*a* and a base 32*b* of the exit guide 32, and the light source portion 26*a* is disposed at a side at which the conveyance guide face 32*a* is disposed. In the present embodiment, the exit guide 32 is entirely transparent. However, in some embodiments, the exit guide 32 may have an optical transparency at at least the conveyance guide face 32*a* opposing the light source portion 26*a*. In the present embodiment, transparent resin is used to allow the emitted charge-removing light K to pass through the conveyance guide face 32*a* to reach the photoconductor surface 10*a*. However, the optical transparency of the exit guide 32 is not necessarily limited to the transparency obtained by a transparent material. Since it is sufficient to set the optical transparency to such a level that a light amount to remove charges can be obtained, a translucent material, a colored material, such as a red material, or an obscure material having fine asperities formed by, for example, sand blasting may be used. As illustrated in FIG. 2, an irradiation target position B3 is set to a position at which the photoconductor surface 10*a* is irradiated with the charge-removing light K between the transfer nip N and the cleaning position B2. Irradiation with the charge-removing light K at the irradiation target B3 removes charges to reduce the residual potential of the photoconductor surface 10*a*. Thus, the charge provided by a charging roller 11 after cleaning by the cleaning blade 15 becomes uniform, which may prevent occurrence of a residual image. A charge can be effectively removed by emitting the charge-removing light K toward the rotational center of the photoconductor 10. Even when the arrangement disallows the charge-removing light K to be emitted toward the rotational center of the photoconductor 10, a sufficient charge-removing effect can still be obtained when a range of pitch angle of approximately ±10 degrees is provided.

The contact between the recording medium P and the photoconductor surface 10*a* at the transfer nip N may cause paper dust on the recording medium P to adhere to the photoconductor surface 10*a*, which may turn to be the adhering substance X1. In particular, if a filler, such as calcium carbonate, kaolin, and white carbon is included in the recording medium P, such a filler may become a major component of paper dust. A material that potentially becomes paper dust is likely to be positively charged and therefore electrostatically adhere to the photoconductor surface 10*a* with a greater force than untransferred toner remaining on the photoconductor surface 10*a*. In addition, the paper dust, which has particle sizes smaller than toner, is likely to slip through the cleaning position B2 at which the photoconductor surface 10*a* and the cleaning blade 15 are in contact with each other. By emitting the charge-removing light K from the charge-removing light source 26 to the irradiation target B3 upstream from the cleaning blade 15 in the photoconductor rotating direction B, the surface potential of the photoconductor 10 is reduced, thus reducing the electrostatic adhesion force between the photoconductor surface 10*a* and the adhering substance X1 (paper dust). As a result, the adhering substance X1 can properly be removed from the photoconductor surface 10*a* and collected by the cleaning blade 15. Thus, a preferable duplication with no longitudinal streak can be obtained.

As described above, regarding the intensity (emitted light amount) of the charge-removing light K emitted to the photoconductor surface 10*a* as the photoconductive layer of the photoconductor 10 before cleaning of the cleaning blade 15, the surface potential of the photoconductor 10 may not necessarily be reduced to a value close to zero. Regarding the intensity (emitted light amount) of the charge-removing light K, the above described effect can be sufficiently obtained if the surface potential of the photoconductor 10 can be reduced to some degree. Therefore, by irradiating the photoconductor surface 10*a* with a light amount resulting from the light emitted from the charge-removing light source 26, which is disposed at the side of the back face Pb of the recording medium P passing through the recording medium P, the electrostatic adhesion force of the adhering substance X1 to the photoconductor surface 10*a* can be reduced. As a result, the adhering substance X1 slipping through the cleaning position B2 at which the cleaning blade 15 performs cleaning can be prevented.

Generally, when the charge amount of toner is small, for example, under a high-temperature and high-humidity, a minute amount of toner may be scattered inside an apparatus body 1A. Although the charge amount of the scattered toner is smaller than the usual toner, the charge may cause the scattered toner to adhere to the light source portion 26*a* of the charge-removing light source 26. In the present embodiment, however, the exit guide 32 having an optical transparency is disposed between the photoconductor 10 and the charge-removing light source 26, thus reducing or preventing the scattered toner adhering to the light source portion 26*a*. The material of the exit guide 32 may be glass, in place of resin, if the glass has a transparency sufficient to obtain a light amount to remove the charge from the photoconductor 10. As illustrated in FIG. 1, the exit guide 32 also serves as a conveyance guide to guide the recording medium P from the transfer nip N (transfer position) to the fixing device 7. The amount of the scattered toner is minute and does not intensively adhere to the transparent exit guide 32, thus preventing blocking of the charge-removing light K over time from discouraging the effect of removing the charge. In addition, since the recording medium P contacts the conveyance guide face 32*a* of the exit guide 32, the contact of the recording medium P against the conveyance guide face 32*a* can provide the effect of cleaning the scattered toner. Thus, the charge-removing light source 26 is disposed away from the downstream conveyance path 9B at the side of the back face Pb of the recording medium P, where relatively large space can be secured and a sufficient amount of light emitted from the charge-removing light source 26 is secured. Such a configuration can suppress an increase in size of the device.

Figure 9:
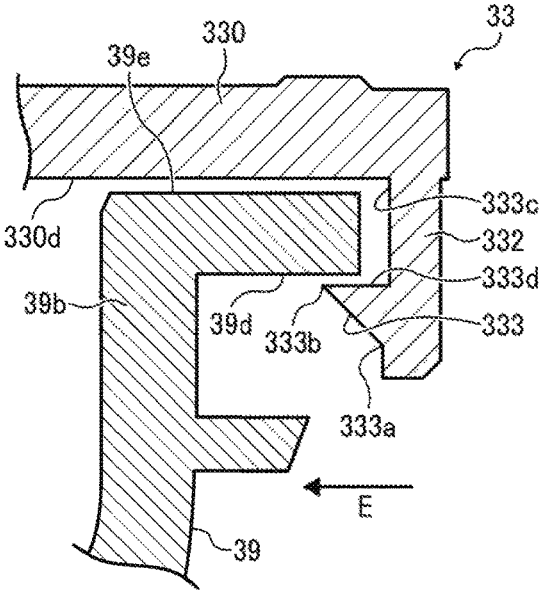
FIG. 9 is an enlarged cross-sectional view of a configuration of another end of the guide and a configuration of a mount portion of a support.
Figure 10:
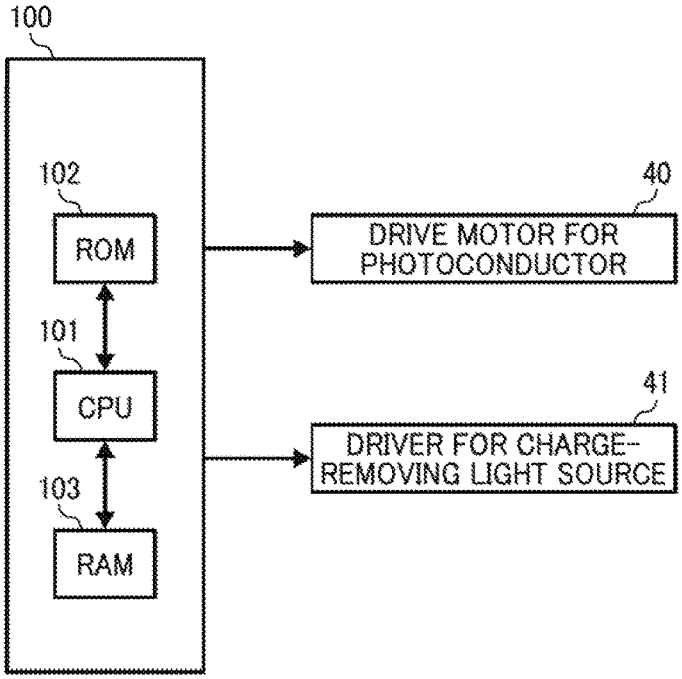
FIG. 10 is a block diagram of a configuration of a control system of the image forming apparatus illustrated in FIG. 1.

Next, control of a light-emission timing of the charge-removing light source 26 is described below. FIG. 9 is a block diagram of a schematic configuration of a control system of the image forming apparatus 1. The image forming apparatus 1 includes a controller 100. The controller 100 includes a central processing unit (CPU) 101 serving as a processor, a read only memory (ROM) 102 serving as a non-volatile memory, and a random access memory (RAM) 103 serving as a temporary storage memory. The controller 100 is connected to devices and sensors via signal lines in a communicating manner to totally control the image forming apparatus 1. In FIG. 9, a part of the devices are illustrated.

Figure 11:
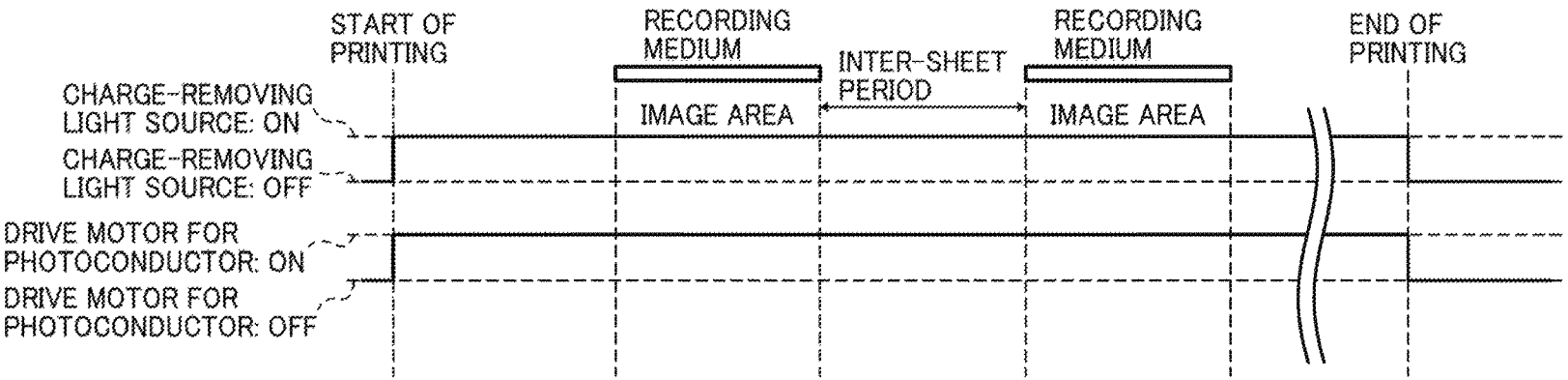
FIG. 11 is a timing chart of an example of emission timing of a charge-removing light source serving as a light irradiator controlled by a controller of the image forming apparatus.

The controller 100 is connected to the drive motor 40 for the photoconductor 10 and a driver 41 for the charge-removing light source 26 via signal lines. The controller 100 controls on and off of the activation of the driver 41 for the charge-removing light source 26 to control the timing of emitting (emission timing of) the charge-removing light K from the charge-removing light source 26. The controller 100 controls the drive motor 40 for the photoconductor 10 to control the rotation speed (linear velocity) of the photoconductor 10. FIG. 11 is a timing chart of an example of the control of emission timing of the charge-removing light source 26. The controller 100 controls (turns on and off) the emission timing of the charge-removing light source 26 in synchronous with the operation timing of the drive motor 40 for the photoconductor 10. For example, in the present embodiment, by activating the drive motor 40, the controller 100 performs on-control on the driver 41 for the charge-removing light source 26 for the photoconductor 10 to emit a charge-removing light K from a light source portion 26*a* toward a photoconductor surface 10*a*. When the operation of the drive motor 40 is stopped, the controller 100 performs off-control on the driver 41 to stop emitting the charge-removing light K from the light source portion 26*a*. In such a control, the charge-removing light source 26 is turned on only during an image formation period in which the photoconductor 10 rotates, so that the degree of optical fatigue of the photoconductor 10 is lower than a configuration in which the charge-removing light K is also emitted during a non image formation period. In other words, if the charge-removing light K is also emitted to the photoconductor surface 10*a* during a period in which the photoconductor 10 does not rotate, the optical fatigue may progress with time, thus accelerating degradation of a photoconductive layer of the photoconductor 10. By contrast, for the present embodiment, the light-emission timing is controlled as described above, thus improving the durability of the photoconductor 10 while securing a sufficient amount of light emitted from the charge-removing light source 26.

Embodiment 1

Figure 5:
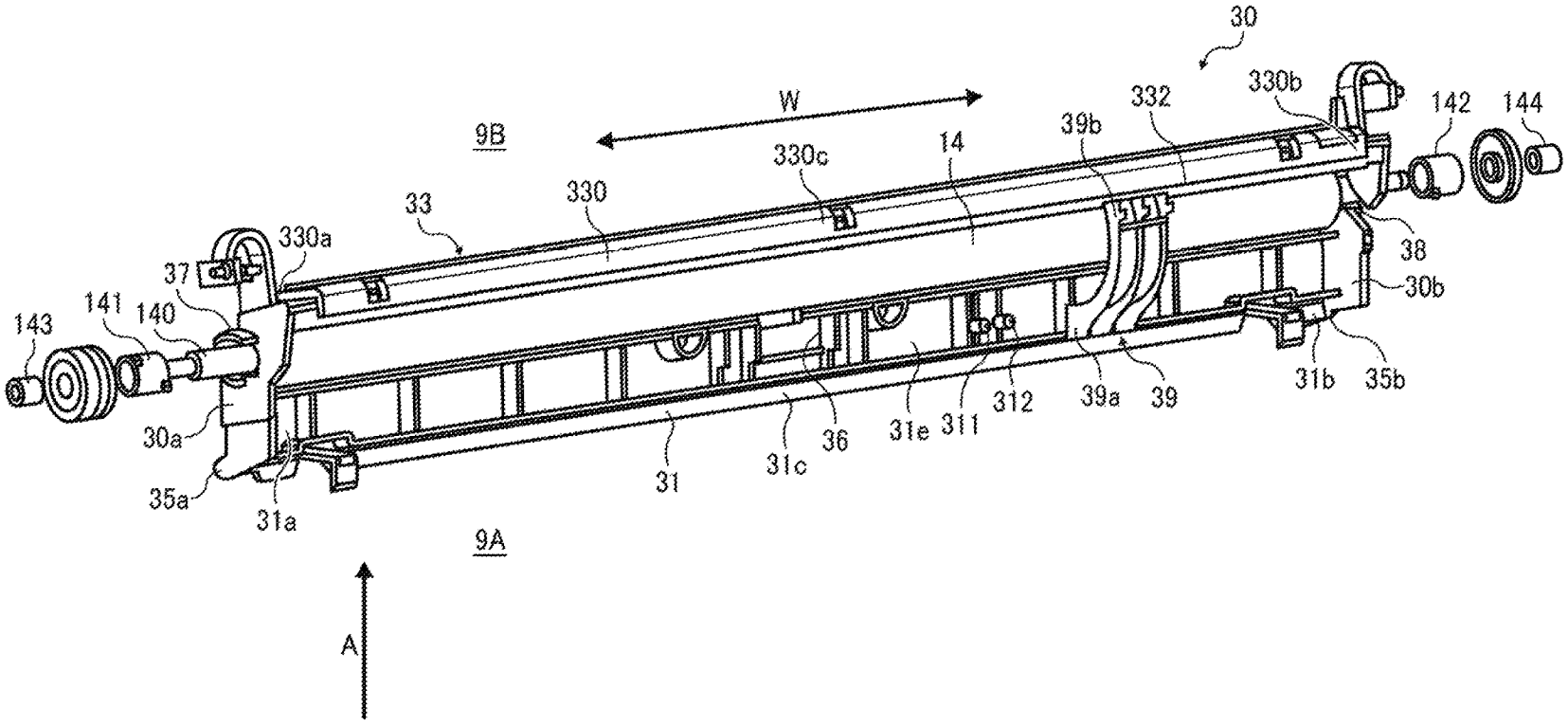
FIG. 5 is an exploded perspective view of a configuration of the conveyance device according to an embodiment of the present disclosure.
Figure 6:
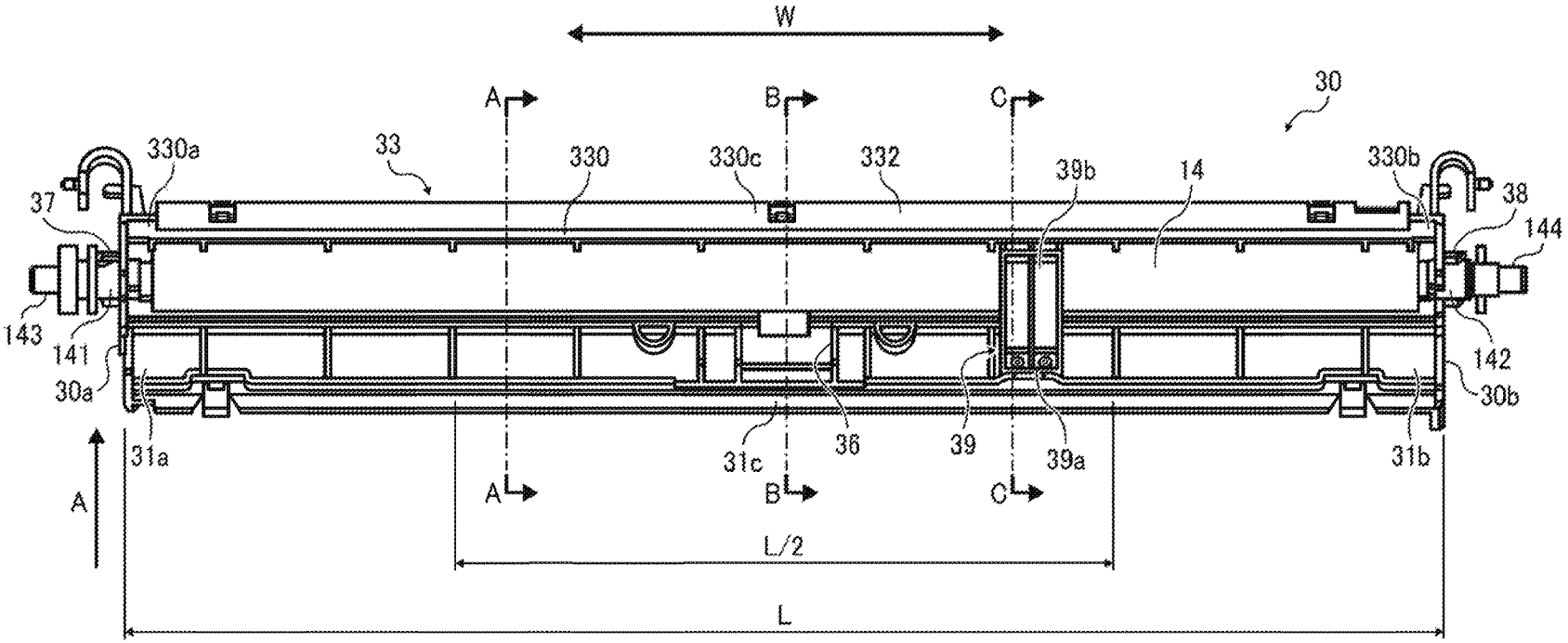
FIG. 6 is an illustration of an assembled state of the conveyance device of FIG. 5.

As illustrated in FIGS. 2 and 3, the conveyance device 30 is disposed upstream from the transfer nip N as the transfer position, at which an image is transferred from the photoconductor 10 onto the recording medium P, in the recording-medium conveyance direction A and includes the entry guide 31 as the guide to guide the recording medium P conveyed. The entry guide 31 is a transfer entry guide (conveyance guide) disposed at the upstream conveyance path 9A between the paired registration rollers 19 and the transfer nip N. As illustrated in FIGS. 5 and 6, the entry guide 31 extends in the longitudinal direction (width direction) W. The entry guide 31 is formed straddling between an end 31*a* and an end 31*b* in the longitudinal direction (width direction) W and has a conveyance guide face 31*d* facing the upstream conveyance path 9A at a side at which the recording medium P passes. The entry guide 31 includes a positioning portion 35*a* at the end 31*a* and a positioning portion 35*b* at the end 31*b* to position the end 31*a* and the end 31*b* relative to the photoconductor surface 10*a*. A central portion 31*c* of the entry guide 31 has a mouth 36 partially cut out. The mouth 36 is formed to secure a detection area of the P-sensor 18. When the conveyance device 30 is mounted and set to an apparatus body 1A, as illustrated in FIG. 2, the positioning portion 35*a* and the positioning portion 35*b* contact a frame 1B of the apparatus body 1A to determine the distance between the photoconductor surface 10*a* and each of the end 31*a* and the end 31*b* of the entry guide 31.

The conveyance device 30 according to the present embodiment includes a charge-removing needle unit 33 and the transfer roller 14. Accordingly, the conveyance device 30 is also a transfer device (secondary transfer device). The charge-removing needle unit 33 is disposed between the transfer roller 14 and the exit guide 32, more specifically, between the transfer nip N and the charge-removing light source 26, which is downstream from the transfer nip N in the recording-medium conveyance direction A. For the charge-removing needle unit 33, as illustrated in FIG. 4, a plurality of metal charge-removing needles 331 as charge removers is linearly arranged along the width direction W and supported on a charge-removing case 330 as a grounded support. As illustrated in FIG. 3, the tips of the charge-removing needles 331 point the downstream conveyance path 9B and contact the recording medium P, which has passed through the transfer nip N, to remove a charge from the recording medium P.

As illustrated in FIG. 5, the end 31*a* and the end 31*a* of the entry guide 31 are coupled with an end 330*a* and an end 330*b* of the charge-removing case 330 via a side plate 30*a* and a side plate 30*b*, respectively, disposed at ends in the width direction W. The side plate 30*a* and the side plate 30*b* has a bearing holder 37 and a bearing holder 38, respectively, to hold a bearing 141 and a bearing 142 to rotatably support a shaft 140 of the transfer roller 14. In other words, the entry guide 31, the charge-removing case 330, the bearing holder 37, and the bearing holder 38 are made of resin and integrally molded as a single unit. Accordingly, the entry guide 31 and the charge-removing needle unit 33 are integrally molded as the single unit. Ends of the transfer roller 14 are rotatably supported by the bearing 141 and the bearing 142 mounted to the bearing holder 37 and the bearing holder 38, and the transfer roller 14 is mounted to the side plate 30*a* and the side plate 30*b*. A roller 143 and a roller 144 are rotatably supported on the shaft 140 of the transfer roller 14. The roller 143 and the roller 144 have the same diameter. When the conveyance device 30 is mounted and set to the apparatus body 1A, as illustrated in FIG. 2, the roller 143 and the roller 144 contact a frame IC of the apparatus body 1A to act as positioners to determine the positions of the transfer roller 14 and the photoconductor 10.

Figure 7A:
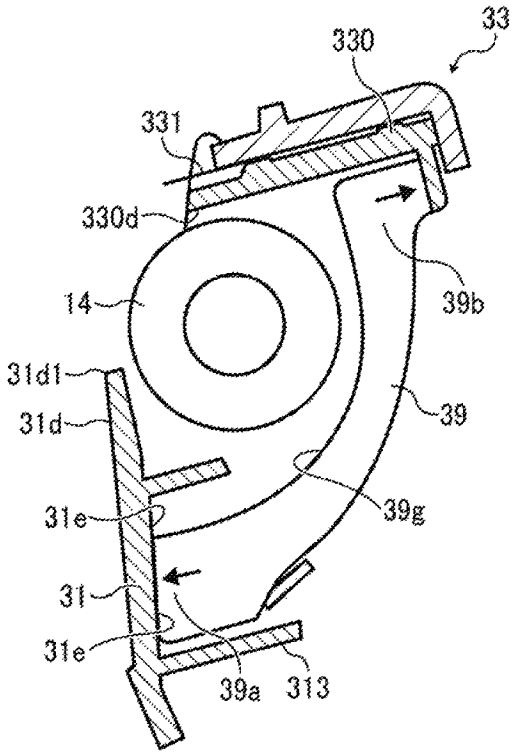
FIG. 7A is a cross-sectional view of the conveyance device cut along line A-A of FIG. 6.
Figure 7B:
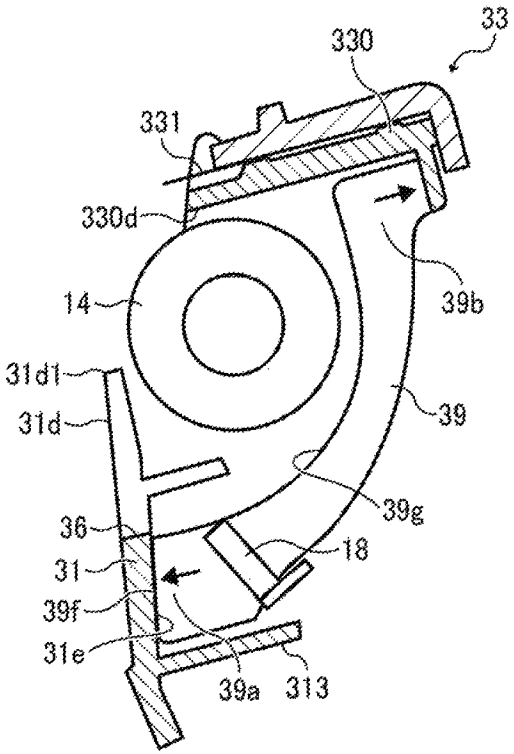
FIG. 7B is a cross-sectional view of the conveyance device cut along line B-B of FIG. 6.

As illustrated in FIGS. 5 and 6, the conveyance device 30 includes a corrector 39 having an end 39*a* to contact a contact face 31*e* at a position closer to the central portion 31*c* than each of the end 31*a* and the end 31*b* of the entry guide 31 to push the central portion 31*c* of the entry guide 31 toward the photoconductor surface 10*a*. The contact face 31*e* is a back face of the entry guide 31 at an opposite side of the conveyance guide face 31*d*. The corrector 39 is a pusher and a brace. As illustrated in FIGS. 7A to 7A, the corrector 39 is a resin member having a side-surface shape curved from the end 39*a* to the other end 39*b* in an arc shape. The end 39*a* of the corrector 39 is mounted to and contact a position near the central portion 31*c* of the entry guide 31. The other end 39*b* of the corrector 39 is mounted to the charge-removing case 330. In other words, the end 39*a* is a contact portion to contact the contact face 31*e* of the entry guide 31, and the other end 39*b* is a portion different from the contact portion. The corrector 39 is mounted to the entry guide 31 and the charge-removing case 330 (the charge-removing needle unit 33) so as to straddle between a vicinity of the central portion 31*c* of the entry guide 31 and the charge-removing case 330.

Figure 7C:
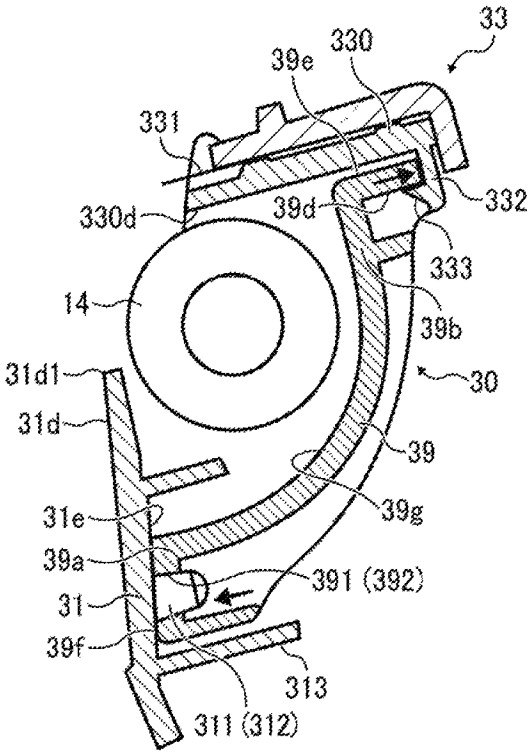
FIG. 7C is a cross-sectional view of the conveyance device cut along line C-C of FIG. 6.
Figure 8A:
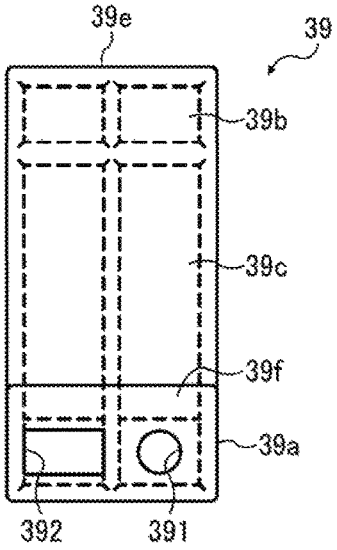
FIG. 8A is a schematic view of the corrector as a pusher of the conveyance device, seen from a side at which the pusher is pressed against the guide.
Figure 8B:
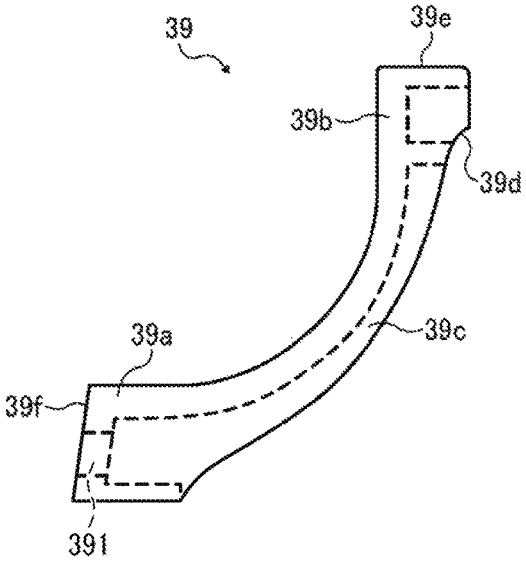
FIG. 8B is a side view of the corrector seen from a longitudinal direction of the corrector.
Figure 8C:
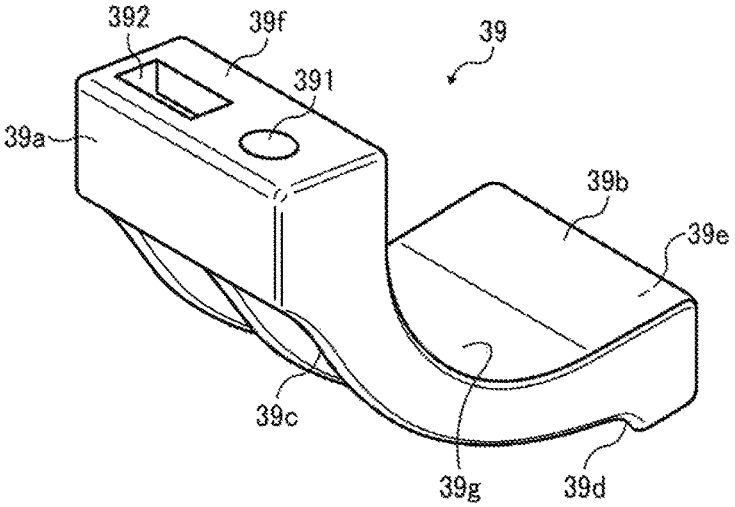
FIG. 8C is an enlarged perspective view of the corrector.

As illustrated in FIG. 6, the vicinity of the central portion 31*c* of the entry guide 31 that the end 39*a* of the corrector 39 contacts is an area in a range of L/2 around the center of the entry guide 31, where L represents the entire length of the entry guide 31 in the longitudinal direction (the width direction) W. As illustrated in FIGS. 8A to 8C, the end 39*a* of the corrector 39 has a circular hole 391 as a mouth and a long rectangular hole 392. As illustrated in FIGS. 5 and 6, the entry guide 31 includes a boss 311 and a boss 312 projecting from the contact face 31*e* that the end 39*a* contacts. The boss 311 and the boss 312 are inserted into the circular hole 391 and the long rectangular hole 392 at the end 39*a* of the corrector 39 to position the end 39*a* of the corrector 39. As illustrated in FIGS. 7C and 8C, an opposed face 39*g* of the corrector 39 opposing the transfer roller 14 is formed in a curved shape. The charge-removing case 330 made of resin extends in the longitudinal direction (the width direction) W, and the end 330*a* and the end 330*b* are coupled with the side plate 30*a* and the side plate 30*b*. Accordingly, a central portion 330*c* of the charge-removing case 330 is deformable to bend relative to the end 330*a* and the end 330*b* in the longitudinal direction (the width direction) W. As illustrated in FIG. 7C, when the other end 39*b* is mounted to the charge-removing case 330 with the boss 311 and the boss 312 inserted to the circular hole 391 and the long rectangular hole 392 of the end 39*a*, the charge-removing case 330 is bent and mounted to the entry guide 31 and the charge-removing case 330.

The entry guide 31 includes a guide holder 313 to hold an insertion state in which the boss 311 and the boss 312 are inserted into the circular hole 391 and the long rectangular hole 392. The guide holder 313 is formed to project outward beyond the boss 311 and the boss 312. The guide holder 313 is a shape of tongue and is disposed to form a space between the guide holder 313 and each of the boss 311 and the boss 312. The charge-removing case 330 has a mount portion 332 that the other end 39*b* of the corrector 39 hooks. As illustrated in FIGS. 3 and 9, the mount portion 332 includes a slanted face 333 slanted relative to a direction indicated by arrow E (hereinafter, mount direction E) in which the other end 39*b* is mounted. The slanted face 333 projects from an outer end 333*a* toward an inner end 333*b* in FIG. 9. In the mount portion 332, the inner end 333*b* and a connecting face 333*d* connected to the inner end 333*b* and an inner wall 333*c* constitutes a claw portion. When the other end 39*b* of the corrector 39 is mounted to the charge-removing case 330, a mount face 39*d* of the other end 39*b* is mounted on the connecting face 333*d*. The corrector 39 is mounted to the charge-removing case 330 so that the connecting face 333*d* is away from an end face 39*e* of the other end 39*b* of the corrector 39 facing a bend face 330*d* of the charge-removing case 330.

As described above, in the present embodiment, the corrector 39 contacts the entry guide 31 at a position closer to the central portion 31*c* in the longitudinal direction W than the positioning portion 35*a* and the positioning portion 35*b* of positioning the end 31*a* and the end 31*b* of the entry guide 31, to push the conveyance guide face 31*d* toward the pbotoconductor 10. Such a configuration allows positioning of the entry guide 31 and the photoconductor surface 10*a* at the position closer to the central portion 31*c*. In other words, the bending of the central portion 31*c* is reduced, thus stabilizing the relative positions of the entry guide 31 and the photoconductor surface 10*a*. Accordingly, a stable conveyance of the recording medium P can be obtained, thus reducing occurrence of an abnormal image. With the positioning portion 35*a* and the positioning portion 35*b* of the end 31*a* and the end 31*b* and the corrector 39 at the position closer to the central portion 31*c*, the relative positions of the entry guide 31 and the photoconductor surface 10*a* are stabilized across a whole range of the entry guide 31 in the longitudinal direction (width direction) W. Accordingly, a stable conveyance of the recording medium P can be obtained, thus more effectively reducing occurrence of an abnormal image. The end 39*a* of the corrector 39 brings a contact face 39*f* being an end face of the end 39*a* into contact with a position of the contact face 31*e*, which is an opposite side of the conveyance guide face 31*d* of the entry guide 31, closer to the central portion 31*c*. Such a configuration can reduce the warping of the conveyance guide face 31*d* of the entry guide 31. The corrector 39 can be disposed at a place having an enough room near the central portion 31*c* of the entry guide 31 in the width direction W, thus allowing downsizing of the conveyance device 30. The transfer roller 14, the entry guide 31, the charge-removing case 330, and the corrector 39 can be assembled as a single unit, thus allowing enhancement of ease of maintenance. The corrector 39 is preferably disposed to push the conveyance guide face 31*d* of the entry guide 31 toward the photoconductor 10. In other words, the direction in which the corrector 39 pushes the entry guide 31 is preferably substantially the same as a direction vertical to the conveyance guide face 31*d*, in other words, a normal direction of the conveyance guide face 31*d* (the leftward direction in FIG. 3). Such a configuration can reliably reduce the warping of the conveyance guide face 31*d*.

In the present embodiment, as illustrated in FIGS. 4 and 7C, the entry guide 31 and the charge-removing case 330 are bridged by the corrector 39 to form a single unit, thus obviating the necessity to separately increase the hardness of the entry guide 31 and the charge-removing case 330. Accordingly, even with some constraints of the setting space or structure, such a configuration can reduce the occurrence of an abnormal image. In the present embodiment, the warping of the entry guide 31 is corrected by contacting the contact face 39*f* of the end 39*a* of the corrector 39 with the central portion 31*c*, at which warpage is largest in the entry guide 31. Such a configuration can obviate the necessity to separately increase the hardness of the entry guide 31 and the charge-removing case 330 and reduce the occurrence of an abnormal image even with some constraints of the setting space or structure. In addition, a gap between the photoconductor surface 10*a* and a leading end 31*d*1 of the conveyance guide face 31*d* of the entry guide 31 can be properly maintained, thus reducing the occurrence of an abnormal image.

In the present embodiment, the boss 311 and the boss 312 projecting from the contact face 31*e* of the entry guide 31 are inserted into the circular hole 391 and the long rectangular hole 392 of the corrector 39. Accordingly, the entry guide 31 can hold the corrector 39 and prevent dropping of the corrector 39, and a good operability can be obtained. The entry guide 31 can be corrected to preset target corrected positions by positioning actions of the boss 311 and the boss 312. Accordingly, the relative positions of the photoconductor surface 10*a* and the entry guide 31 can be more accurately maintained, thus more reliably reducing the occurrence of an abnormal image. As described above, the entry guide 31 includes the guide holder 313 to hold the insertion state in which the boss 311 and the boss 312 are inserted into the circular hole 391 and the long rectangular hole 392. Accordingly, even when the other end 39*b* of the corrector 39 is removed from the charge-removing case 330, the corrector 39 can be held by the entry guide 31 at only the end 39*a* side of the corrector 39, thus enhancing the operability while preventing dropping of the corrector 39. In the present embodiment, the charge-removing case 330 is bent to mount the corrector 39 so as to straddle between the entry guide 31 and the charge-removing case 330. Accordingly, the corrector 39 can be held in a state in which the corrector 39 is sandwiched between the charge-removing case 330 and the entry guide 31 by an elastic deforming force of the charge-removing case 330, thus preventing dropping of the corrector 39 with a more simplified configuration to enhance the operability. In the present embodiment, as illustrated in FIGS. 3, 7C, and 8C, the opposed face 39*g* of the corrector 39 is a curved shape. In other words, the opposed face 39*g* has no irregular or sharp shape. Accordingly, even if the opposed face 39*g* contacts the transfer roller 14, for example, when the corrector 39 is mounted, such a configuration can prevent damage to the surface 14*a* of the transfer roller 14. The charge-removing case 330 is deformable to bend, thus enhancing the operability in removing the corrector 39 from the entry guide 31 and the charge-removing case 330. Note that, instead of the configuration in which the charge-removing case 330 is deformable to bend, the entry guide 31 may be deformable to bend. Such a configuration facilitates mounting of the corrector 39 to the charge-removing case 330 and the entry guide 31. In some embodiments, both of the charge-removing case 330 and the entry guide 31 may be deformable to bend.

For the conveyance device (transfer device) 30 according to the present embodiment, the bearing holder 37 and the bearing holder 38 are integrally molded as a single unit, to hold the entry guide 31, the charge-removing case 330, and the bearing 141 and the bearing 142 of the transfer roller 14. Such a configuration can more stabilize the relative positions of the entry guide 31 and the charge-removing case 330 and enhance the ease of maintenance than the entry guide 31 and the charge-removing case 330 are separately mounted and set to the apparatus body 1A. Note that, in some embodiments, the bearing 141 and the bearing holder 37 may be integrally molded as a single unit. Likewise, in some embodiments, the bearing 142 and the bearing holder 38 may be integrally molded as a single unit. For the conveyance device (transfer device) according to the present embodiment, the charge-removing case 330 includes the mount portion 332, which the other end 39*b* of the corrector 39 hooks. The end 39*a* side of the corrector 39 is inserted into the boss 311 and the boss 312, thus causing the corrector 39 to be mounted to the entry guide 31 and the charge-removing case 330. Such a configuration obviates fasteners, such as screws or bolts, to mount the corrector 39, thus preventing the entry guide 31 from being twisted by a fastening torque arising in fastening operation and reducing the positional change of the entry guide 31. Accordingly, the relative positions of the photoconductor surface 10*a* and the entry guide 31 can be more accurately maintained, thus more reliably reducing the occurrence of an abnormal image.

The mount portion 332 has the slanted face 333 slanted relative to the mount direction E of the other end 39*b* of the corrector 39. Accordingly, when the other end 39*b* moves toward the mount direction E, the other end 39*b* is guided inside by the slanted face 333, thus facilitating the mounting of the other end 39*b* of the corrector 39 to the charge-removing case 330. While the other end 39*b* of the corrector 39 moves on the slanted face 333, a pressing force acts on the slanted face 333 to elastically deform the charge-removing case 330. When the other end 39*b* of the corrector 39 passes the slanted face 333 and the inner end 333*b*, the pressing force acting on the slanted face 333 is released. As a result, the charge-removing case 330 restores and holds the corrector 39 in a state in which the mount face 39*d* is placed on the connecting face 333*d*. Such a configuration can reliably mount and hold the other end 39*b* of the corrector 39 to the charge-removing case 330.

Figure 12:
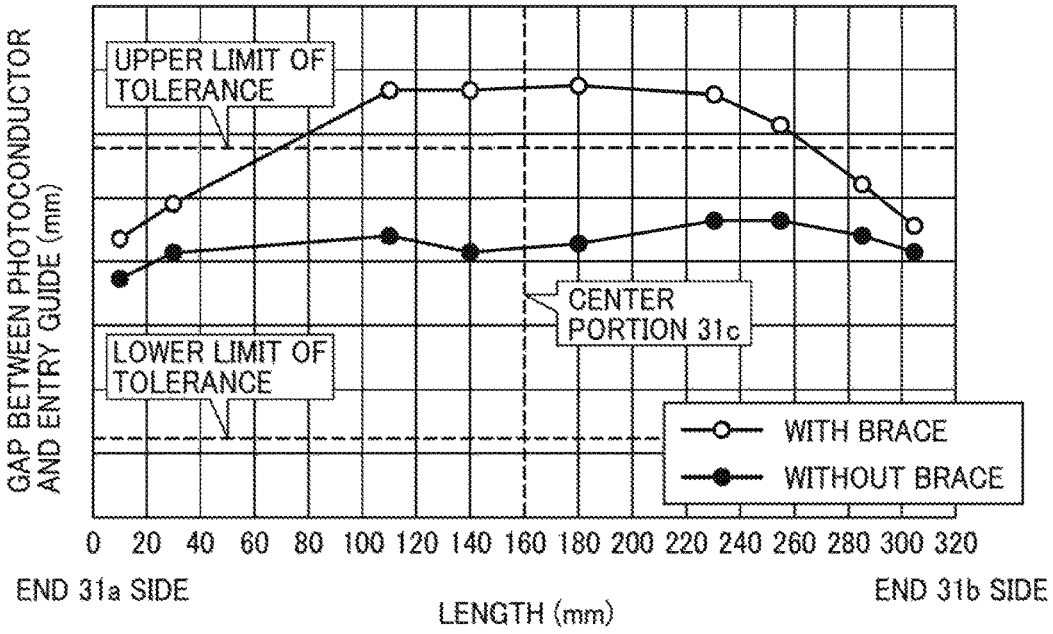
FIG. 12 is a graph of measurement results of a gap in a longitudinal direction between a photoconductor as an image bearer and an entry guide as a guide in configurations with and without the corrector.
Figure 13:
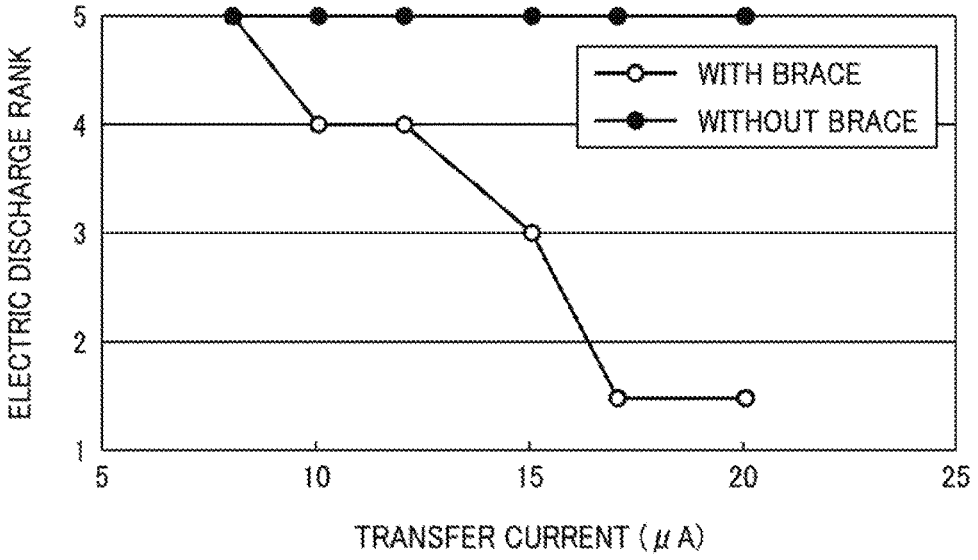
FIG. 13 is a graph of measurement results of electric-discharge image ranks in the configurations with and without the corrector.

FIG. 12 is a graph of measurement results of the gap in the width direction (longitudinal direction) W between the photoconductor surface 10*a* and the entry guide 31 in the configurations with and without the corrector 39. FIG. 13 is a graph of measurement results of electric-discharge image ranks in the configurations with and without the corrector 39. In FIG. 12, the vertical axis represents the gap (mm) between the photoconductor surface 10*a* and the entry guide 31, and the horizontal axis represents the length of the entry guide 31. Specifically, the gap between the leading end 31*d*1 of the conveyance guide face 31*d* of the entry guide 31 and the photoconductor surface 10*a* is measured in an area indicated by broken circle Z in FIG. 3. In FIG. 12, white circles represent gaps in the configuration without the corrector 39, and black circles represent gaps in the configuration with the corrector 39 as described in the present embodiment. The entry guide 31 made of resin constituting the conveyance device 30 extends in the width direction (longitudinal direction) W. Accordingly, slight deformation may arise between the central portion 31*c* and each of the end 31*a* and the end 31*b*. Therefore, the upper limit and the lower limit of allowable tolerance are set for the gap, and the range from the upper limit to the lower limit is an allowable tolerance range. For the configuration without the corrector 39, the gap of the central portion 31*c* is greater than the upper limit of allowable tolerance, and the gap of each of the end 31*a* and the end 31*b* is not greater than the upper limit of allowable tolerance. By contrast, for the configuration with the corrector 39, the gap of the central portion 31*c*, as well as the gap of each of the end 31*a* and the end 31*b*, are within the allowable tolerance range from the upper limit to the lower limit of allowable tolerance and less variations between the gap of the central portion 31*c* and the gap of each of the end 31*a* and the end 31*b*. Therefore, the arrangement of the corrector 39 described in the present embodiment can stabilize the gap between the photoconductor surface 10*a* and the entry guide 31.

In FIG. 13, the vertical axis represents electric-discharge image ranks 1 to 5, and the horizontal axis represents transfer current in unit of μA. In FIG. 13, white circles represent ranks of electric-discharge properties in the configuration without the corrector 39, and black circles represent ranks of electric-discharge properties in the configuration with the corrector 39 as described in the present embodiment. Of the electric-discharge image ranks, rank 1 is the lowest and rank 5 is the highest. For the configuration without the corrector 39, as the transfer current increases, the electric-discharge image rank decreases. One reason of the results is, for example, as follow. As the transfer current is lower, electric discharge is unlikely to occur even if there are gap variances. However, as the transfer current is higher and the gap variances are greater, electric discharge is likely to occur and partially drops out a tone image, thus increasing the occurrence of an abnormal image including, for example, white spots. By contrast, in the configuration with the corrector 39, even when the transfer current is higher, the electric-discharge image rank does not fall and is maintained at rank 5. One reason of the results is, for example, as follow. When there are no gap variances, that is, the preset target gap is maintained, electric discharge does not occur, thus reducing the occurrence rate of an abnormal image including, for example, white dots, to a quite low rate.

Figure 14:
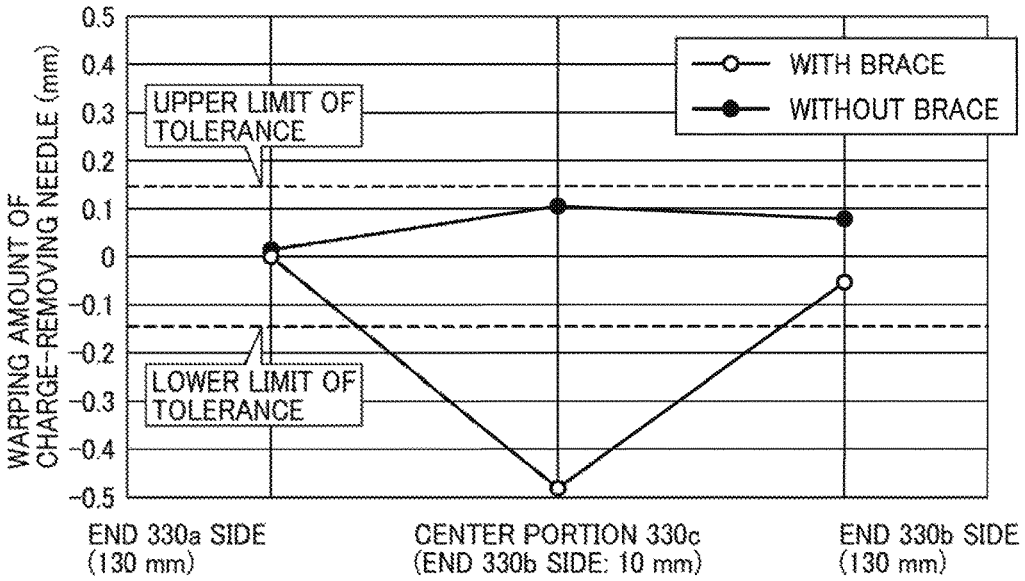
FIG. 14 is a graph of measurement results of the amount of warpage of charge-removing needles in the longitudinal direction in the configurations with and without the corrector.

FIG. 14 is a graph of measurement results of the amount of warpage of the charge-removing needles 331 in the longitudinal direction (width direction) W in the configurations with and without the corrector 39. As the measurement position of each of the charge-removing needles 331, the distance between the transfer roller 14 and the charge-removing case 330 holding the charge-removing needles 331 is measured. In FIG. 14, the vertical axis represents the amount of warpage (mm) of the charge-removing needles 331, and the horizontal axis represents the positions in the longitudinal direction (width direction) W. In FIG. 14, white circles represent the amount of warpage in the configuration without the corrector 39, and black circles represent the amount of warpage in the configuration with the corrector 39 as described in the present embodiment. The charge-removing case 330 constituting the charge-removing needle unit 33 of the conveyance device 30 extends in the width direction (longitudinal direction) W. Accordingly, slight deformation may arise between the central portion 330*c* and each of the end 330*a* and the end 330*b*. Consequently, warpage is caused by deformation of the charge-removing needles 331 held. Hence, the upper limit and the lower limit of allowable tolerance are set for the gap, and the range from the upper limit to the lower limit is an allowable tolerance range. For the configuration without the corrector 39, the amount of warpage of the central portion 330*c* is lower than the lower limit of allowable tolerance, and the amount of warpage of each of the end 330*a* and the end 330*b* is not lower than the lower limit of allowable tolerance. By contrast, for the configuration with the corrector 39, the amount of warpage of the central portion 330*c*, as well as the amount of warpage of each of the end 330*a* and the end 330*b*, are within the allowable tolerance range from the upper limit to the lower limit of allowable tolerance and less variations between the amount of warpage of the central portion 330*c* and the gap of each of the end 330*a* and the end 330*b*. Therefore, the arrangement of the corrector 39 described in the present embodiment can stabilize the amount of warpage of the charge-removing needle unit 33 including the charge-removing needles 331 and the charge-removing case 330. Such a configuration can properly remove a charge from the recording medium P with the charge-removing needles 331 while obtaining the separability of a recording medium P by the charge-removing needles 331, thus reducing the occurrence of an abnormal image including, for example, dust particles.

Figure 15:
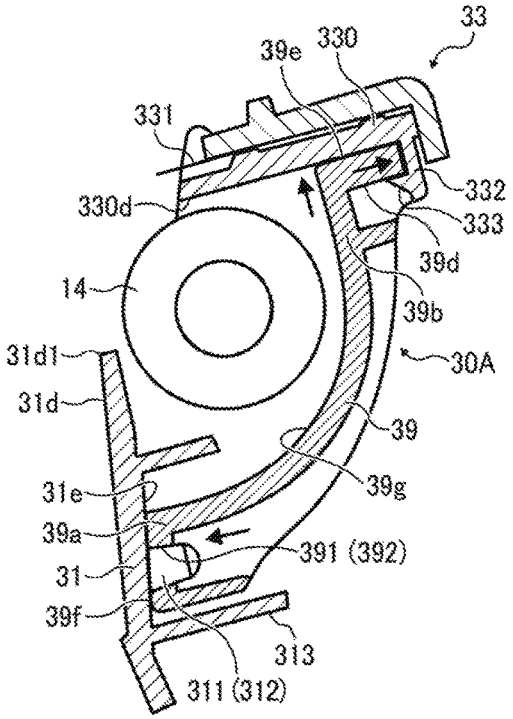
FIG. 15 is an enlarged cross-sectional view of a configuration of the conveyance device in which the corrector is in contact with the support.

In the above-described embodiment, the corrector 39 is mounted to the charge-removing case 330 so that the connecting face 333*d* is away from an end face 39*e* of the other end 39*b* of the corrector 39 facing a bend face 330*d* of the charge-removing case 330. However, the mounting of the corrector 39 is not limited to such a configuration. For example, in some embodiments of the present disclosure, a conveyance device 30A illustrated in FIG. 15 may be mounted to the charge-removing case 330 so that the end face 39*e* of the other end 39*b* of the corrector 39 contacts or more preferably pressed against the bend face 330*d* of the charge-removing case 330. As described above, when the end face 39*e* of the other end 39*b* of the corrector 39 contacts the bend face 330*d* of the charge-removing case 330, the amount of bend of the charge-removing case 330 is large. As a result, the position closer to the central portion 330*c*, which is larger in the amount of warpage of the charge-removing case 330, can be supported by the end face 39*e*. Such a configuration can reduce the amount of warpage of the charge-removing needles 331 due to deformation of the charge-removing case 330 and maintain the charge-removing needles 331 at a proper position, thus more reliably reducing the occurrence of an abnormal image.

Figure 16:
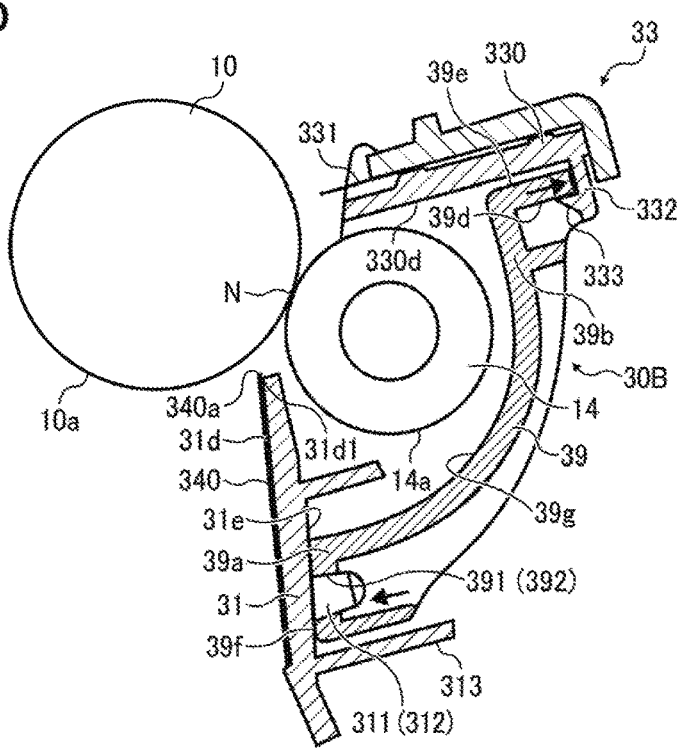
FIG. 16 is an enlarged cross-sectional view of a configuration of the conveyance device in which a conductive sheet as a conductive member is disposed on the guide.

For a conveyance device 30B illustrated in FIG. 16, a conductive sheet 340 as a conductive member is disposed on the conveyance guide face 31*d* of the entry guide 31 so that an end 340*a* of the conductive sheet 340 projects toward the photoconductor 10 beyond the leading end 31*d*1. The conductive sheet 340 disposed on the conveyance guide face 31*d* can prevent the entry guide 31 from being charged by friction with the recording medium P. Accordingly, such a configuration can prevent charging of the recording medium P while preventing the entry guide 31 from being soiled by adhesion of toner. In addition, as described above, the conductive sheet 340 is disposed to project toward the photoconductor 10 beyond the leading end 31*d*1 of the conveyance guide face 31*d*. Such a configuration can more reliably prevent charging of the recording medium P while preventing the leading end 31*d*1 near the photoconductor 10 from being charged and soiled by adhesion of toner.

In the above-described embodiment, the single corrector 39 as the pusher to correct deformation of the entry guide 31 is disposed at a position slightly shifted from the central portion 31*c* to the other end 31*b* within the range of L/2. One reason of the arrangement in which the corrector 39 is not disposed at the central portion 31*c* is that the mouth 36 for the P-sensor 18 is formed at the central portion 31*c*. However, in a case in which the P-sensor 18 is disposed at a different location, the corrector 39 may be disposed at the central portion 31*c* and mounted to straddle between the entry guide 31 and the charge-removing case 330 and form a single unit with the entry guide 31 and the charge-removing case 330. The number of the corrector 39 is not limited to one. For example, two correctors 39 may be disposed line-symmetrically with respect to the central portion 31*c* within the range of L/2. In such a configuration, the force of supporting the central portion 31*c* and the hardness of the conveyance device 30 are greater than in the configuration with the single corrector 39. Accordingly, the gap between the photoconductor surface 10*a* and the entry guide 31 can be more stabilized, thus reducing the occurrence of abnormal image. In some embodiments, by contrast, the single corrector 39 may be disposed at a position closer to the end 31*a* than the central portion 31*c* within the range of L/2. Such a configuration can also obtain operational effects equivalent to the effects in the above-described embodiment.

Figure 17:
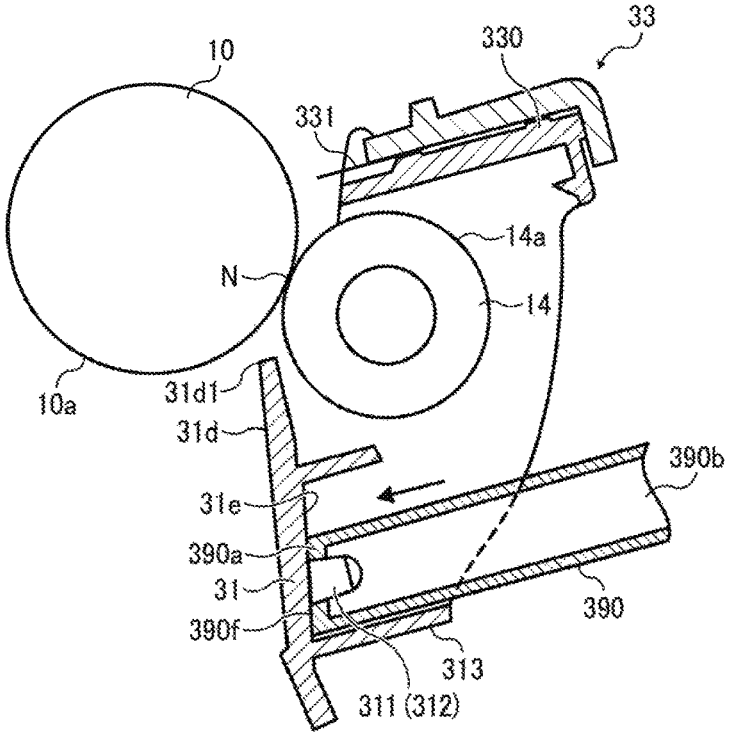
FIG. 17 is a cross-sectional view of a configuration in which the corrector is separately disposed.
Figure 18:
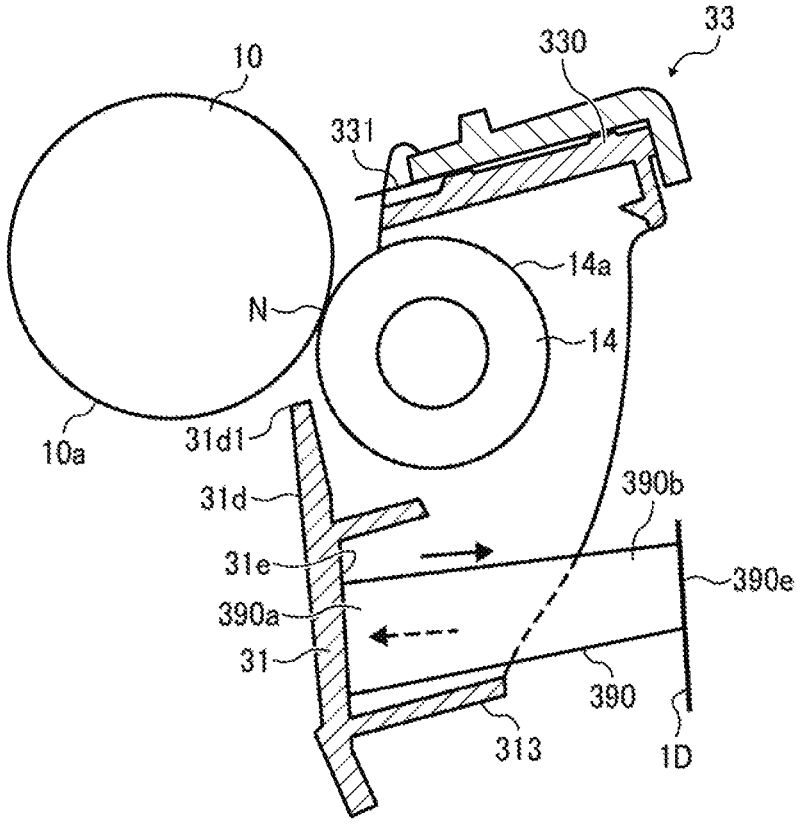
FIG. 18 is a cross-sectional view of a configuration in which the corrector is integrally molded with the guide.

In the above-described embodiment, the corrector 39 is disposed to straddle between the entry guide 31 and the charge-removing case 330, thus enhancing the hardness of the entry guide 31 and the charge-removing case 330 to reduce deformation of the entry guide 31 and the charge-removing case 330. However, in some embodiments of the present disclosure, the conveyance device may not include the charge-removing needle unit 33. In such a configuration, it is sufficient to reduce deformation of an area near the central portion 31*c* of the entry guide 31. Hence, for example, as illustrated in FIG. 17, a contact face 390*f* of one end 390*a* of a corrector 390 as the pusher may be pressed against the contact face 31*e* of the entry guide 31. The other end 390*b* of the corrector 390 may be secured to, for example, the apparatus body 1A. Alternatively, as illustrated in FIG. 18, the corrector 390 may be a rib integrally molded as a single unit with the entry guide 31. In such a case, the one end 390*a* of the corrector 390 is connected to the entry guide 31, and a contact face 390*e* of the other end 390*b* contacts or more preferably presses against a secured portion 1D of, e.g., the apparatus body 1A. Thus, inward deformation of the central portion 31*c* can be reduced or preferably corrected.

Alternatively, in some embodiments, a support may be disposed downstream (at an upper side in FIG. 3) from the transfer nip N in the recording-medium conveyance direction A, to support a different portion of the corrector 390 from a portion which the entry guide 31 contacts. In such a configuration, the support may support the charge-removing needles 331 or no charge-removing needles may be disposed on the support. Such a configuration can support the corrector 390 by utilizing a space at the back face Pb side of the recording medium P (the right side in FIG. 3) from the transfer nip N, the space extending in a direction (the top-and-bottom direction in FIG. 3) parallel to the recording-medium conveyance direction A. Such a configuration can reduce the warpage of the entry guide 31 without upsizing the device. In such a configuration, the corrector 390 is preferably mounted to the entry guide 31 and the support to straddle between the entry guide 31 and the support. Such a configuration can enhance the operability in assembling the conveyance device 30 including the corrector 390. In the above-described embodiment, the entry guide 31, the charge-removing case 330, the bearing holder 37, the bearing holder 38, the side plate 30*a*, and the side plate 30*b* are made of resin. However, the material of the components is not limited to resin and may be, for example, partially metal.

In the above-described embodiment, four positioners, that is, the positioning portion 35*a*, the positioning portion 35*b*, the roller 143, and the roller 144 are disposed. However, the number of positioners are not limited to four. For example, the number of the positioners may be one, two, three, or five or more. In some embodiments, the positioners may be disposed to contact the ends of the photoconductor surface 10*a* in the longitudinal direction (width direction) W. In the above-described embodiment, the photoconductor 10 is employed as the image bearer. However, in some embodiments, for example, the image bearer may be an intermediate transfer belt onto which an image (toner image) is primarily transferred from a photoconductor. The above-described embodiments may be applied with modifications to an image forming apparatus that secondarily transfers the image (toner image) from the intermediate transfer belt onto the recording medium P.

In the above-described embodiment, the conveyance device 30 includes the positioning portion 35*a*, the positioning portion 35*b*, the roller 143, and the roller 144 to position the end 31*a* and the end 31*b* of the entry guide 31 relative to the photoconductor 10, and also includes the corrector 39 disposed at a position closer to the central portion 31*c* than each of the end 31*a* and the end 31*b* in the longitudinal direction W. However, in some embodiments, the conveyance device 30 may not include the positioning portion 35*a*, the positioning portion 35*b*, the roller 143, and the roller 144. For example, in some embodiments, the end 31*a* and the end 31*b* of the entry guide 31 and the photoconductor 10 may be directly or indirectly via, e.g., a frame or a unit by the apparatus body (housing) 1A. In such a configuration, the conveyance device 30 may include the corrector 39 to contact the central portion 31*c* at a position closer to the center than each of the end 31*a* and the end 31*b* of the entry guide 31 to correct the warpage of the entry guide 31. For example, the image forming apparatus 1 may include the apparatus body (housing) 1A, the photoconductor 10 supported by the apparatus body (housing) 1A, the entry guide 31 having the longitudinal end 31*a* and the longitudinal end 31*b* supported by the apparatus body (housing) 1A, to guide a recording medium P at a position upstream from the transfer position (the transfer nip N), at which an image is transferred from the photoconductor 10 onto the recording medium P, and the corrector 39 to contact the entry guide 31 at a position closer to the central portion 31*c* than each of the end 31*a* and the end 31*b* in the longitudinal direction W to correct the warpage of the entry guide 31. In such a configuration, the warpage of the entry guide 31 is corrected at the position closer to the central portion 31*c*, at which the warpage relative to the end 31*a* and the end 31*b* is likely to occur. Accordingly, the position of the central portion 31*c* of the entry guide 31 relative to the photoconductor surface 10*a* can be properly determined, thus stabilizing the conveyance of the recording medium P and reducing the occurrence of an abnormal image.

The above-described embodiments are examples of embodiments. Modifications and alterations of the embodiments can be made without departing from the spirit and scope of the invention described in the claims unless limited in the above description. For example, the image forming apparatus is not be limited to an image forming apparatus and may be, for example, a printer, a stand-alone fax machine, or a multifunction peripheral including at least two functions of a copier, a printer, a fax machine, and a scanner. The effects obtained by the above-described embodiments are examples. The effects obtained by other embodiments are not limited to the above-described effects.

What is claimed is:

1. A conveyance device comprising:

a guide extending in a longitudinal direction of an image bearer and disposed upstream from a transfer position, at which an image is transferred from the image bearer to a recording medium, in a direction of conveyance of the recording medium to guide the recording medium;

a positioner to position an end of the guide relative to the image bearer;

a charge remover case directly supporting charge removers arranged in a perpendicular direction to the direction of conveyance of the recording medium; and a pusher having one end contacting the guide at a position closer to a center of the guide than the end of the guide in the longitudinal direction and another end contacting the charge remover case, to push the guide toward the image bearer.

2. The conveyance device according to claim 1, wherein the charge remover case is disposed downstream from the transfer position in the direction of conveyance of the recording medium.

3. The conveyance device according to claim 2, wherein the pusher extends between the guide and the charge remover case.

4. The conveyance device according to claim 2, wherein the charge remover case is bendable, and wherein the pusher is mounted to the guide and the charge remover case with the charge remover case bent by the pusher.

5. The conveyance device according to claim 4, wherein the pusher is mounted to the charge remover case in contact with a bent surface of the charge remover case bent by the pusher.

6. The conveyance device according to claim 2, further comprising:

a mount portion that an end of the pusher hooks, wherein the mount portion has a slanted face slanted relative to a direction in which the another end of the pusher contacting the charge remover case is mounted.

7. The conveyance device according to claim 2, wherein the guide and the charge remover case are integrally molded as a single unit.

8. The conveyance device according to claim 2, further comprising:

a transferor forming the transfer position between the transferor and the image bearer;

a bearing rotatably supporting the transferor; and a bearing holder holding the bearing, wherein the guide, the charge remover case, and the bearing holder are integrally molded as a single unit.

9. The conveyance device according to claim 1, wherein the guide includes a conveyance guide face at a side at which the recording medium passes, and wherein the pusher is disposed to push the conveyance guide face toward the image bearer.

10. The conveyance device according to claim 9, further comprising a conductive member disposed on the conveyance guide face and projecting toward the image bearer beyond a leading end of the conveyance guide face.

11. The conveyance device according to claim 1, wherein the pusher contacts a position within a range of L/2 around the center of the guide, where L is a length of the guide in the longitudinal direction.

12. The conveyance device according to claim 1, wherein the guide includes a boss at a portion at which the guide contacts the pusher, and wherein the pusher has a hole into which the boss is inserted.

13. The conveyance device according to claim 12, wherein the guide includes a guide holder to hold a state in which the boss is inserted into the hole.

14. An image forming apparatus comprising:

the image bearer;

a transferor disposed opposite the image bearer to form the transfer position between the transferor and the image bearer; and the conveyance device according to claim 1 extending in the longitudinal direction of the image bearer and disposed upstream from the transfer position in the direction of conveyance of the recording medium, to guide the recording medium.

15. An image forming apparatus comprising:

a housing;

an image bearer supported by the housing;

a guide disposed upstream from a transfer position, at which an image is transferred from the image bearer to a recording medium, in a direction of conveyance of the recording medium to guide the recording medium, the guide having an end in a longitudinal direction of the guide;

a charge remover case directly supporting charge removers arranged in a perpendicular direction to the direction of conveyance of the recording medium; and a corrector having one end contacting the guide at a position closer to a center of the guide than the end of the guide in the longitudinal direction and another end contacting the charge remover case, to correct warpage of the guide.

16. The image forming apparatus according to claim 15, wherein the end of the guide is supported by the housing.

17. The image forming apparatus according to claim 15, wherein the end of the guide includes a positioning portion to contact the housing and position the end of the guide relative to the image bearer.

* * * * *